US008362374B2

(12) United States Patent
Grül et al.

(10) Patent No.: US 8,362,374 B2
(45) Date of Patent: Jan. 29, 2013

(54) APPARATUS FOR MUTUAL INTERLOCKING OF TWO SWITCHES, IN PARTICULAR CIRCUIT BREAKERS

(75) Inventors: Klaus Grül, Alfter (DE); Michel Hess, Winterthur (CH); Harald Krieger, Neuhaus (DE)

(73) Assignee: Siemens Aktiengesellschaft, Munich (DE)

( * ) Notice: Subject to any disclaimer, the term of this patent is extended or adjusted under 35 U.S.C. 154(b) by 250 days.

(21) Appl. No.: 12/854,249

(22) Filed: Aug. 11, 2010

(65) Prior Publication Data

US 2011/0036700 A1 Feb. 17, 2011

(30) Foreign Application Priority Data

Aug. 13, 2009 (DE) ..... 10 2009 037 372

(51) Int. Cl.
*H01H 9/20* (2006.01)

(52) U.S. Cl. ..... 200/50.32; 200/50.3; 200/50.4

(58) Field of Classification Search ..... 200/50.01, 200/50.32–50.4

See application file for complete search history.

(56) References Cited

U.S. PATENT DOCUMENTS

| | | | | |
|---|---|---|---|---|
| 2,646,474 | A * | 7/1953 | Stratton | 200/50.33 |
| 2,798,188 | A | 7/1957 | Matthias | |
| 2,982,827 | A * | 5/1961 | Goetz | 200/50.24 |
| 3,562,452 | A * | 2/1971 | Keogh et al. | 200/50.33 |
| 3,736,538 | A * | 5/1973 | Owen | 200/50.35 |
| 4,103,133 | A * | 7/1978 | Erickson et al. | 200/50.34 |
| 4,190,755 | A * | 2/1980 | Rogers | 200/334 |
| 4,499,344 | A * | 2/1985 | Castonguay et al. | 200/50.33 |
| 4,827,089 | A | 5/1989 | Morris et al. | |
| 5,319,169 | A * | 6/1994 | Link et al. | 200/401 |
| 5,436,415 | A * | 7/1995 | Smith et al. | 200/50.35 |
| 5,763,844 | A * | 6/1998 | Seymour et al. | 219/69.13 |
| 6,043,439 | A * | 3/2000 | Crooks et al. | 200/50.33 |
| 6,066,814 | A * | 5/2000 | Smith et al. | 200/50.24 |

(Continued)

FOREIGN PATENT DOCUMENTS

| | | | |
|---|---|---|---|
| DE | 1264579 | B | 3/1968 |
| DE | 2226174 | A1 | 12/1973 |

(Continued)

OTHER PUBLICATIONS

German priority document DE 10 2009 037 372.1, filed Aug. 13, 2009, not yet published.

*Primary Examiner* — Briggitte R Hammond
(74) *Attorney, Agent, or Firm* — Harness, Dickey & Pierce, P.L.C.

(57) ABSTRACT

An apparatus is disclosed for mutual interlocking of two switches, in particular circuit breakers. In at least one embodiment, the apparatus includes two plungers which each engage in one of the two switches and can be moved in the plunger longitudinal direction, wherein, when one switch is being switched on, the plunger which engages in this switch is moved by pivoting of a control disk from its nil-point position to its opening position. In at least one embodiment, the apparatus includes a blocking device which blocks pivoting of the other control disk by moving the plunger to its opening position. In order to achieve a maintenance-free apparatus, in at least one embodiment it is proposed that at least one blocking element of the blocking device is moved by the plunger when this plunger is being moved to its opening position, such that pivoting of the other control disk with respect to the other plunger, which is located in the nil-point position, is blocked.

10 Claims, 2 Drawing Sheets

U.S. PATENT DOCUMENTS

| | | | | |
|---|---|---|---|---|
| 6,486,421 | B1 * | 11/2002 | Jones et al. | 200/50.32 |
| 6,617,533 | B1 | 9/2003 | Hall | |
| 6,861,596 | B2 * | 3/2005 | Schnackenberg | 200/43.01 |
| 7,019,229 | B1 * | 3/2006 | Weister et al. | 200/50.17 |

FOREIGN PATENT DOCUMENTS

| | | | |
|---|---|---|---|
| DE | 3917280 | A1 | 12/1989 |
| JP | 10055728 | A | 2/1998 |

* cited by examiner

APPARATUS FOR MUTUAL INTERLOCKING OF TWO SWITCHES, IN PARTICULAR CIRCUIT BREAKERS

PRIORITY STATEMENT

The present application hereby claims priority under 35 U.S.C. §119 on German patent application number DE 10 2009 037 372.1 filed Aug. 13, 2009, the entire contents of which are hereby incorporated herein by reference.

FIELD

At least one embodiment of the invention generally relates to an apparatus for mutual interlocking of two switches, in particular circuit breakers.

BACKGROUND

Mutual interlocks are known in particular as accessories for circuit-breaker configurations with, for example, two switches arranged alongside one another. The interface between a circuit breaker and an interlock is in this case frequently formed by a control-disk/plunger mechanism. The control disk may be integrated in a switch-internal drive shaft; the interlock is driven, and the switch is prevented from being switched on, via this drive shaft. In this case, the plunger enters the circuit breaker and forms the connecting element between the switch-internal control disk and the switch-external interlock. A blocking device with two plungers is used for mutual interlocking of the two switches. When a circuit breaker is switched on, its plunger is moved by the control disk from its nil-point position to its opening position. At the same time, the other plunger is moved, for example by positive coupling, from its nil-point position to its interlocking position. When the plunger has reached the interlocking position, the associated circuit breaker is blocked, that is to say it is no longer possible to switch the circuit breaker on. For correct operation of the interlock, it is necessary for the contact surfaces of the control disk and the plunger to each be located at precisely predetermined positions. Any discrepancy is possible only within tight tolerances, which leads to considerable sensitivity to manufacturing tolerances and wear. The positions of the control disk and plunger must in each case be readjusted for correction.

The "floating" nil-point position is responsible for the tight tolerances. Although this is defined by the control-disk/plunger mechanism, there is, however, no physically usable reference for this. When the mechanism is in the rest state, then the plunger is in each case held in the nil-point position by the interlock. If parts and components of the interlock do not correspond to their nominal value (shape and position tolerances, wear), then this influences the position of the plunger, that is to say it deviates from its nil-point position.

SUMMARY

In at least one embodiment of the invention, a maintenance-free apparatus is disclosed for mutual interlocking of two circuit breakers.

At least one embodiment of the invention provides that at least one blocking element of the blocking device is moved by the plunger when this plunger is being moved to its opening position, such that pivoting of the other control disk with respect to the other plunger, which is located in the nil-point position, is blocked. The idea of at least one embodiment of the invention is to amalgamate the blocking area and the nil-point position, as a result of which the plunger need not enter the housing any further than its nil-point position. It is therefore possible to provide the control disk with a stop which corresponds to the nil-point (physically usable reference). In the rest state, the plunger is pressed into the housing against the stop by the interlock. The control disk and the plunger are therefore always correctly positioned with respect to one another in the rest state; there is no longer any need for adjustment (and, in addition, such adjustment is no longer possible). The apparatus is considerably less sensitive to shape and position tolerances of the individual parts and components of the interlock.

In one simple embodiment, the control disk has a control contour which increases radially outward in the circumferential direction and interacts with the end of the associated plunger.

It is technically simple if the blocking element is moved.

One technically effective embodiment provides that the blocking element is a ball chain, whose balls are pushed apart from one another by the plunger moving to its opening position, and are thus moved transversely with respect to the plunger longitudinal direction, with one of the balls being pushed into the movement range of the other plunger, and thus blocking its movement.

Alternatively, it is possible for the blocking element to be pivoted.

One simple embodiment in this case provides that the blocking device is formed from two elements which can pivot about a common axis which runs transversely with respect to the plunger longitudinal direction, wherein the pivoting of one element prevents pivoting of the other element.

In order to effectively block the pivoting of the other element in the latter case, it is proposed that when one element pivots, a stop element which blocks pivoting of the other element is also pivoted.

BRIEF DESCRIPTION OF THE DRAWINGS

The invention will be described in more detail in the following text with reference to one example embodiment. In the figures:

FIG. 5 shows a blocking device with a walking beam as a blocking element, before a switch is switched on, and FIG. 6 shows the blocking device as shown in FIG. 5, after a switch has been switched on.

DETAILED DESCRIPTION OF THE EXAMPLE EMBODIMENTS

Figure 1:
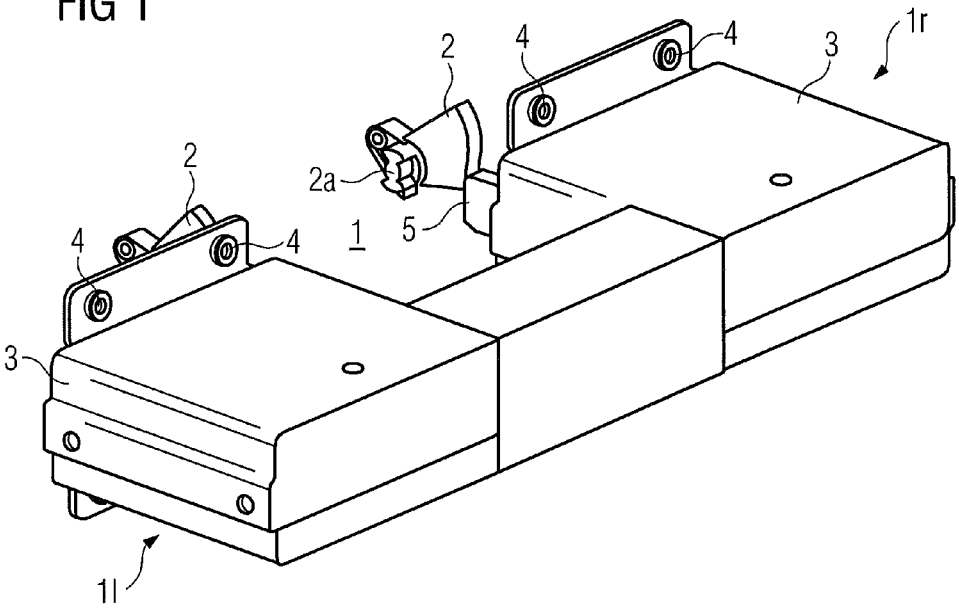
FIG. 1 shows an apparatus for mutual interlocking of two switches, illustrated schematically.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an apparatus 1 for mutual interlocking of two circuit breakers, referred to in the following text only as switches. For the sake of simplicity, only the control disk 2 is shown in the two switches in FIG. 1, and this control disk 2 can be pivoted about an axis 2*a* via a switch drive shaft, which is likewise not shown.

The two switches are normally mounted alongside one another on a corresponding mounting plate. The control disk 2 which is shown on the left-hand side in FIG. 1 therefore belongs to the left-hand switch, and the right-hand control disk 2 belongs to the right-hand switch. The apparatus is formed from two components. One component 1*l* is associated with the left-hand switch, and one 1*r* is associated with the right-hand switch. The two components 1*l*, 1*r* each has a frame, which in this case at the same time acts as a protective cover 3. The components 1*l*, 1*r* are mounted externally on the switch rear face, on the mounting plate, by means of an appropriate attachment plate (or angled plate). FIG. 1 shows through-holes 4 for the attachment screws for mounting the components 1*l*, 1*r* on the attachment plate.

Plungers 5 which enter the switches interact with the control disk 2 of the switch. This control-disk/plunger mechanism forms the interface between the switch and the interlock, and the plunger 5 in each case forms the connecting element between the switch-internal control disk 2 and the switch-external interlock, in this case in the form of a blocking device. The latter is located within the cover 6, and extends into the two components 1*l*, 1*r*.

Before a switch is switched on, both plungers 5 are in their nil-point position, as is shown in the illustration in FIG. 1.

Figure 2:
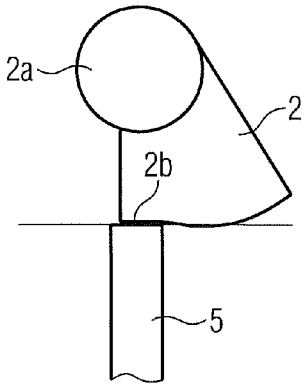
FIG. 2 shows the interaction of a control disk and associated plunger before a switch is switched on, FIG. 3 shows the interaction of a control disk and an associated plunger after a switch has been switched on, FIG. 4 shows a blocking device with a ball chain as a blocking element.
Figure 3:
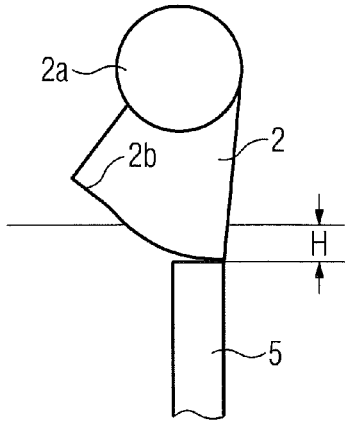

FIG. 2 schematically shows the nil-point position for a control disk 2 and the associated plunger 5. When the switch is being switched on, the plunger 5 is pushed by the control disk 2 from its nil-point position to its opening position out of the switch, as is illustrated in FIG. 3. The maximum movement of the plunger 5 is the travel H.

The idea of an embodiment of the invention is to amalgamate the blocking area and the nil-point position on the control disk 2. This makes it possible to provide the control disk 2 with a stop 2*b* which corresponds to the nil-point position (nil point as a physically usable reference). In the nil-point position or in the rest state, the plunger 5 is pushed by the interlock against the stop 2*b* into the housing of the switch. The control disk 2 and the plunger 5 are therefore always positioned uniquely with respect to one another in the rest state, and there is no longer any need for adjustment (and this is also no longer possible). The apparatus is therefore considerably less sensitive to shape and position tolerances of the individual parts and components of the interlock.

As shown in FIGS. 2 and 3, the control contour of the control disk 2 runs increasing radially outward in the circumferential direction, in which case a small (transitional) threshold is expediently connected (can be connected) to the planar stop 2*b*.

Figure 4:
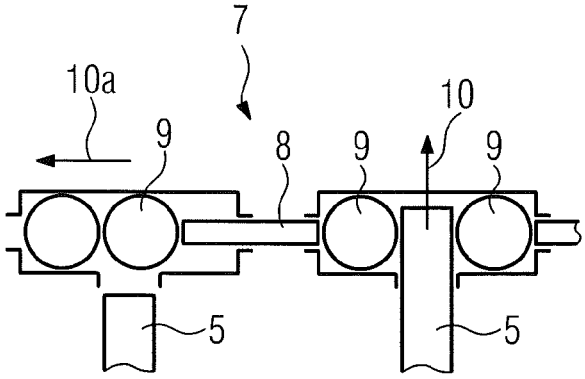

FIG. 4 schematically shows a blocking device 7 having a blocking element which is in the form of a ball chain 8. In this case, when the switch is being switched on, the plunger 5 is pushed between two balls 9 in the ball chain 8 (arrow 10), and the blocking element is therefore moved transversely with respect to the plunger longitudinal direction (arrow 10*a*). When the plunger 5 is in its opening position—as shown in FIG. 4—these two balls 9 are pushed apart from one another. In this case, one of the balls 9*a* is pushed into the movement channel (movement area) of the other plunger 5, thus blocking the capability of the latter to move longitudinally.

Figure 5:
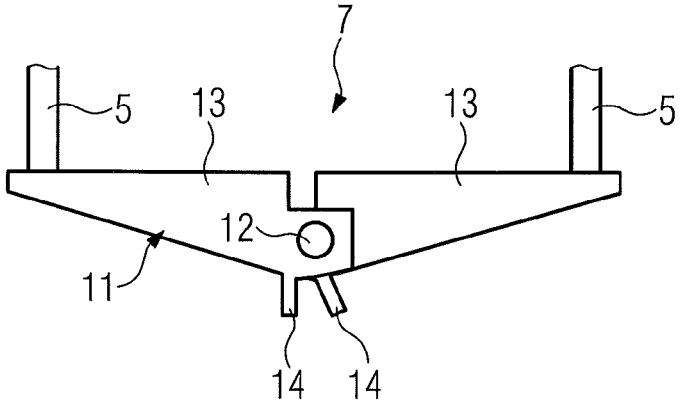
Figure 6:
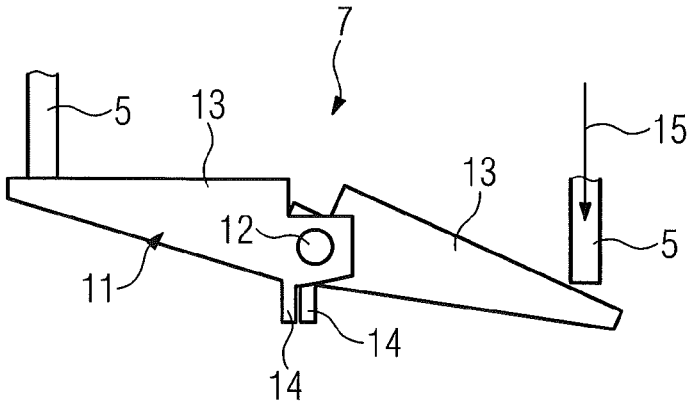

FIG. 5 schematically shows an alternative blocking device 7 having a blocking element in the form of a walking beam 11. The walking beam 11 consists of two elements 13 which can pivot about a common axis 12 which runs transversely with respect to the plunger longitudinal direction, with the pivoting of one element 13 (as shown in FIG. 6, movement of the plunger 5 in the direction of the arrow 15) blocking pivoting of the other element 13. The blocking is created by means of a stop element 14, which is in each case also pivoted with the element 13.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for mutual interlocking of two switches, comprising:

two plungers, each of the two plungers engaging in one of the two switches and being movable in a longitudinal direction of the plunger, wherein, when one switch is being switched on, the one of the two plungers which engages in the one switch is moved by pivoting of a control disk from a nil-point position to an opening position; and a blocking device to block pivoting of another control disk by moving the one of the two plungers which engages in the one switch its opening position, at least one blocking element of the blocking device being moved by the one of the two plungers which engages in the one switch when the one plunger is being moved to its opening position, such that pivoting of the another control disk with respect to the other of the two plungers, which is located in the nil-point position, is blocked.

2. The apparatus as claimed in claim 1, wherein the control disk includes a control contour which increases radially outward in a circumferential direction and interacts with the end of the associated one plunger.

3. The apparatus as claimed in claim 1, wherein the at least one blocking element is moved.

4. The apparatus as claimed in claim 3, wherein the blocking element is a ball chain, whose balls are pushed apart from one another by the one plunger moving to its opening position, and are thus moved transversely with respect to the longitudinal direction of the one plunger, with one of the balls being pushed into the movement channel of the other of the two plungers, and thus blocking its longitudinal movement.

5. The apparatus as claimed in claim 1, wherein the blocking element is pivoted.

6. The apparatus as claimed in claim 5, wherein the blocking element is formed from two elements which are pivotable about a common axis which runs transversely with respect to the plunger longitudinal direction, wherein the pivoting of one element prevents pivoting of the other element.

7. The apparatus as claimed in claim 6, wherein, when one element pivots, a stop element which blocks pivoting of the other element is also pivoted.

8. The apparatus as claimed in claim 1, wherein the two switches are circuit breakers.

9. The apparatus as claimed in claim 2, wherein the at least one blocking element is moved.

10. The apparatus as claimed in claim 2, wherein the blocking element is pivoted.

* * * * *